US007702114B2

(12) United States Patent
Aarts

(10) Patent No.: US 7,702,114 B2
(45) Date of Patent: Apr. 20, 2010

(54) HIGH EFFICIENCY AUDIO TRANSDUCER

(75) Inventor: Ronaldus Maria Aarts, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/571,630

(22) PCT Filed: Aug. 30, 2004

(86) PCT No.: PCT/IB2004/051605

§ 371 (c)(1),
(2), (4) Date: Mar. 14, 2005

(87) PCT Pub. No.: WO2005/027570

PCT Pub. Date: Mar. 24, 2005

(65) Prior Publication Data

US 2007/0026903 A1 Feb. 1, 2007

(30) Foreign Application Priority Data

Sep. 16, 2003 (EP) ..... 03103396

(51) Int. Cl.
*H04R 29/00* (2006.01)

(52) U.S. Cl. ..... 381/59; 381/61; 381/98; 381/96; 381/111; 381/97

(58) Field of Classification Search ..... 381/162, 381/386, 191, 396, 398, 400, 401, 407, 409, 381/410, 412, 413, 414
See application file for complete search history.

(56) References Cited

U.S. PATENT DOCUMENTS

| | | | | |
|---|---|---|---|---|
| 3,917,914 | A * | 11/1975 | Parker | 381/416 |
| 4,160,133 | A * | 7/1979 | Wiik | 381/401 |
| 4,297,538 | A * | 10/1981 | Massa | 381/340 |
| 4,829,581 | A * | 5/1989 | Nieuwendijk et al. | 381/398 |
| 6,611,135 | B1 * | 8/2003 | Schroeder | 324/76.51 |
| 6,628,792 | B1 * | 9/2003 | Paddock | 381/182 |
| 2003/0002684 | A1 * | 1/2003 | Coats | 381/61 |
| 2003/0123692 | A1 * | 7/2003 | Ueki | 381/398 |
| 2004/0086140 | A1 * | 5/2004 | Fedigan et al. | 381/96 |

* cited by examiner

*Primary Examiner*—Wayne R Young
*Assistant Examiner*—Dionne H Pendleton

(57) ABSTRACT

A transducer (1) for producing sound in response to an electrical signal comprises an actuator (2) with a magnet (4) and a coil (5), and a vibration surface (3), for example a loudspeaker cone. The actuator and the vibration surface are mechanically coupled. The transducer (1) is designed to operate at substantially its resonance frequency ($f_0$). This results in a very high transducer efficiency, which is particularly relevant for rendering low audio frequencies.

11 Claims, 2 Drawing Sheets

HIGH EFFICIENCY AUDIO TRANSDUCER

Figure 1:
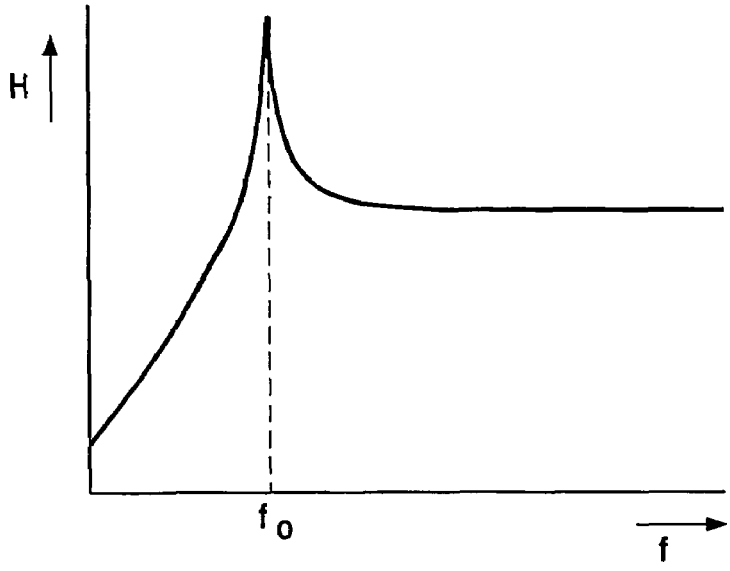

The present invention relates to a high efficiency audio transducer. More in particular, the present invention relates to a transducer for producing sound in response to an electrical signal, the transducer comprising an actuator and a vibration surface which are mechanically coupled. Such transducers are generally known. Loudspeakers used for audio (stereo) systems, for example, typically have a cone made of carton or plastic which acts as a vibration surface. The actuator of a regular loudspeaker comprises a magnet and a coil. The magnet may be stationary while the coil is mechanically coupled to the cone, or vice versa.

It is well known that audio frequencies range from approximately 20 Hz to approximately 20 kHz. While the middle range (approx. 1-10 kHz) can be reliably reproduced by regular loudspeakers, special transducers are typically required for the lower and higher frequency ranges. High fidelity audio systems typically include small transducers ("tweeters") for reproducing the high audio frequency range, medium size transducers ("squawkers") for rendering the middle audio frequency range and relatively large transducers ("woofers") for the low range. The transducers required to faithfully reproduce the lowest audible frequencies (approx. 20-100 Hz) at a suitable sound level take up a substantial amount of space. However, there is an increasing demand for miniature audio sets. It is obvious that the requirements of large transducers and small audio equipment are incompatible.

It is an object of the present invention to overcome these and other problems of the Prior Art and to provide a sound transducer which is compact and yet is capable of producing low-frequency sound signals at a relatively high sound level.

Accordingly, the present invention provides a transducer for producing sound in response to an electrical signal, the transducer comprising an actuator and a vibration surface which are mechanically coupled, the actuator comprising a magnet and a coil, wherein the transducer is designed to operate at substantially its resonance frequency.

By providing operating the transducer at or near its resonance frequency, a very substantial sound output volume may be achieved, even using a relatively small transducer at relatively low audio frequencies. The present invention effectively uses the resonance of the transducer to produce sound, and optimizes the transducer at the resonance frequency. This optimization can be achieved in several ways, for example by maximizing the input sensitivity of the transducer so that the maximum sensitivity occurs at the resonance frequency.

The input sensitivity is typically measured as a voltage sensitivity (measured in Pa/V) but the efficiency (the ratio of the acoustic output power and the electric input power) may also be used.

In a preferred embodiment, the transducer has a force factor which is equal to the product of the magnetic flux and the length of the coil, the ratio of the force factor squared on the one hand and the product of the electrical resistance and the mechanical resistance of the transducer on the other hand being greater than 0.6 and smaller than 1.4. When this condition is satisfied, the sensitivity of the transducer is optimized at or near its resonance frequency.

As is well known, the force factor mentioned above is an indication of the "power" of the coil. It is surprising that at low values of the mechanical and electrical resistance, a very low value of the force factor and therefore a small coil and a small magnet system suffice.

It is noted that the boundaries of 0.6 and 1.4 mentioned above are approximate and that satisfactory results may be achieved with a ratio of, for example, 0.4 or even 0.2.

In an advantageous embodiment, the ratio mentioned above is greater than 0.9 and smaller than 1.1, said ratio preferably being substantially equal to 1. When the ratio of the force factor squared on the one hand and the product of the electrical resistance and the mechanical resistance of the transducer on the other hand is substantially equal to 1, the transducer has a maximum efficiency at the resonance frequency. However, at relatively small deviations from 1 the efficiency is still high and a high sound volume can be achieved at a relatively small force factor and a relatively small input voltage.

In a first embodiment, the vibration surface is a loudspeaker cone. That is, the transducer is similar to a regular loudspeaker, but its actuator has a different design.

In a second embodiment, the vibration surface comprises an elongate strip. This embodiment is advantageous in that it can be very flat and narrow.

In a third embodiment, the vibration surface comprises a first cylindrical part moveably arranged relative to a second cylindrical part, the first and second cylindrical parts being at least partially concentric.

In the transducer of the present invention it is preferred that the coil is substantially stationary. This implies that the magnet is moveably arranged so as to drive the vibration surface. A substantially stationary coil has the advantage that the electrical leads connected to the coil can be stationary as well and that no flexing of these leads is required, thus prolonging the service life of the transducer. A moving magnet is possible in the transducer of the present invention as only a relatively weak magnetic field having a small flux density (B) is required. However, embodiments can be envisaged in which the magnet is substantially stationary and the coil is moveably arranged.

The present invention additionally provides an audio system comprising a transducer as defined above. Such an audio system may also comprise an amplifier, a tuner, a DVD player, a display (TV) screen, and/or other components.

The present invention further provides a method of driving an audio transducer comprising an actuator and a vibration surface which are mechanically coupled, the method comprising the step of providing an audio input signal to the transducer, wherein the audio input signal has an average frequency which is substantially equal to the resonance frequency of the transducer, and wherein the transducer is designed to operate at substantially its resonance frequency. In said method, the transducer may have a force factor which is equal to the product of the magnetic flux and the length of the coil, the ratio of the force factor squared and the product of the electrical resistance and the mechanical resistance of the transducer advantageously being greater than 0.6 and smaller than 1.4. In a particularly advantageous embodiment, said ratio is greater than 0.9 and smaller than 1.1, the ratio preferably being substantially equal to 1.

The present invention will further be explained below with reference to exemplary embodiments illustrated in the accompanying drawings, in which:

FIG. 1 schematically shows a graphical representation of the voltage sensitivity of a transducer as may be used in the present invention.

Figure 2:
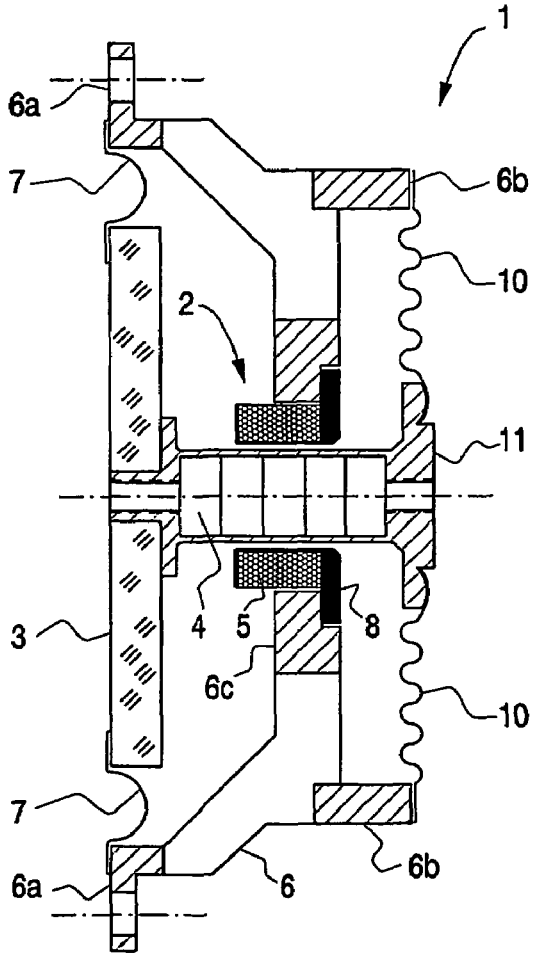

FIG. 2 schematically shows, in a cross-sectional view, a first embodiment of a transducer according to the present invention.

Figure 3:
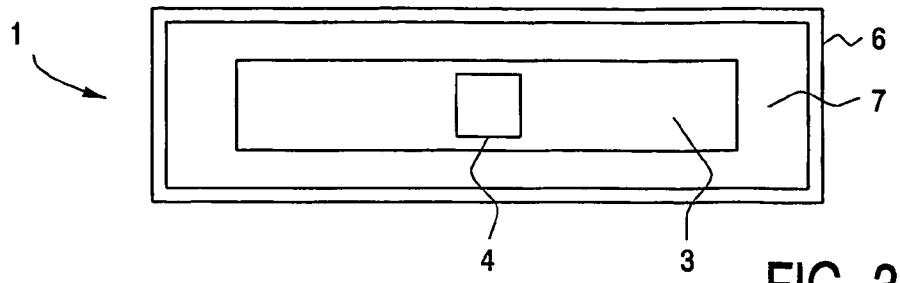

FIG. 3 schematically shows, in plan view, a second embodiment of a transducer according the present invention.

Figure 4:
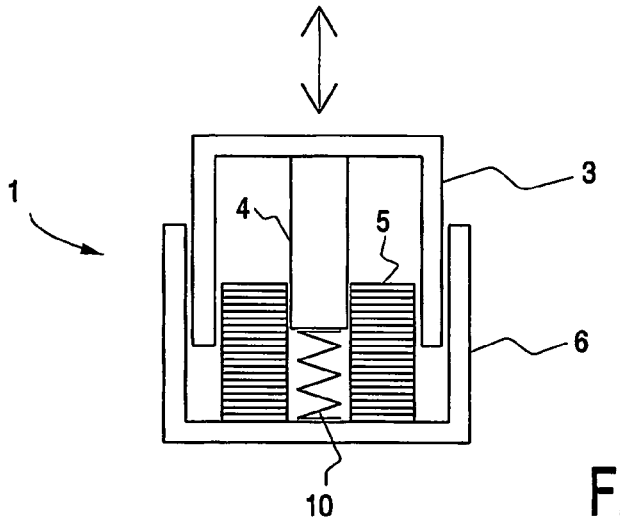

FIG. 4 schematically shows, in a partial cross-section, a third embodiment of a transducer according to the present invention.

Figure 5:
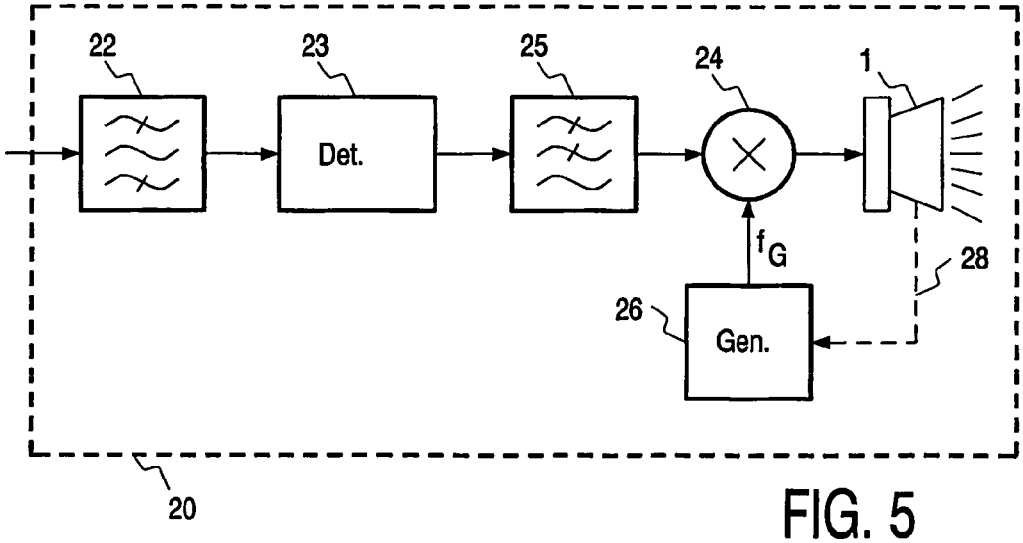

FIG. 5 schematically shows an embodiment of a system in which a transducer according to the present invention is utilized.

In FIG. 1 a graphical representation of the voltage sensitivity of an audio transducer is schematically depicted. The sound pressure level SPL (vertical axis) produced by the transducer is shown to vary with the frequency f (horizontal axis), the input voltage being held constant. As can be seen, the sound pressure level SPL and therefore the sensitivity H (the ratio of the sound pressure and the input voltage) is at a maximum at or near a frequency $f_0$. In accordance with the present invention, the frequency $f_0$ is the resonance frequency of the transducer.

It can be shown mathematically that, when the voltage sensitivity H is defined as $$H=p/V$$

where p is the sound pressure (output) and p is the voltage (input), the voltage sensitivity at the resonance frequency $f_0$ is at a maximum when $$r=(Bl)^2/(Rm\times Re)=1$$

where Bl is the force factor, that is, the product of the density B of the magnetic field in the transducer coil and the length l of the coil, and where Rm and Re are the mechanical resistance of the suspension and the electric resistance of the voice coil respectively. This is remarkable as it allows a high sensitivity to obtained at a relatively low value of the force factor Bl. With exemplary values of Rm=0.05 kg/s and Re=6Ω, a Bl value of only 0.5 N/A is required to achieve a high sensitivity, a high efficiency and hence a high audio output volume at a certain input voltage. As a result, the magnet and the coil of a transducer according to the present invention can be relatively small.

As there is an inverse relationship between the resonance frequency $f_0$ and the moving mass m of the transducer, it is possible to change the resonance frequency $f_0$ by adjusting the moving mass m: when the moving mass m increases, the resonance frequency $f_0$ decreases. In contrast to conventional transducers, such as typical loudspeakers, increasing the moving mass does not lead to a decreased efficiency.

The ratio r discussed above, that is the ratio of the square of the force factor and the product of the mechanical and the electrical resistance, is preferably equal or substantially equal to 1. However, relatively small deviations from the value 1 can still produce satisfactory or very satisfactory results. For example, a value of r in the range from approximately 0.6 to approximately 1.4 may produce good results, a value of r in the range from approximately 0.8 to approximately 1.2 may produce better results while a value of r in range from 0.9 to 1.1 will produce very good to excellent results.

It can further be proven mathematically that the ratio r is equal to the ratio of the mechanical quality measure (Qm) and the electrical quality measure (Qe):

$$r=Qm/Qe$$

It follows that when r=1, the quality measures have identical values:

$$Qm=Qe$$

In other words, the greatest transducer efficiency (r=1) is achieved when the mechanical quality measure equals the electrical quality measure. The quality measures Qm and Qe are quantities which are well known to those skilled in the art.

The transducer 1 shown merely by way of non-limiting example in FIG. 2 comprises an actuator 2 and a vibration surface 3. The actuator 2 may comprise a magnet 4 and a coil 5. In the example shown, the magnet 4 is constituted by a stack of magnet elements arranged in a magnet holder 11. The magnet 4 is mechanically coupled to the vibration surface 3 by the magnet holder 11 and is moveably arranged so as to be able to drive the vibration surface 3. As the magnet 4 is able to move, the coil 5 can be stationary, which in turn makes it possible to use fixed electrical leads (not shown) which are not subjected to wearing due to movements of the coil. However, it should be noted that this arrangement is not essential and that transducers according to the present invention may instead have a stationary magnet and a moveable coil. In the example shown, the coil 5 is fixed to the frame 6 by a holding ring 8.

The vibration surface 3 may be a conventional loudspeaker cone or any other suitable surface, as will later be discussed in more detail. In the example shown, the vibration surface 3 is a relatively stiff, flat disc supported by a ring **6*a* which is part of the frame 6. The frame 6 may be made of metal, for example. The vibration surface itself may be made of plastic, carton or any other suitable material. A suspension (flexible edge) 7 forms the transition between the vibration surface 3 and the ring 6*a*. A resilient element 10 defines the stationary position of the magnet holder 11 and is attached to a ring 6*b* which is also part of the frame 6**.

Due to the substantially flat vibration surface 3 a very compact transducer design is possible.

The transducer has a force factor Bl which is equal to the product of the magnetic flux density B and the length l of the coil. In accordance with the present invention it is preferred that the force factor squared is approximately equal to the product of the electrical resistance Re and the mechanical resistance Rm of the transducer, as discussed above. When this condition is satisfied, the voltage sensitivity of the transducer is optimized at the transducer's resonance frequency. This means that at the resonance frequency the highest sound pressure per volt is obtained, leading to a maximum sound pressure (sound level). In this way, low audio frequencies (for example in the range from 20 Hz to 120 Hz) can be produced at relatively high sound levels provided the resonance frequency $f_0$ is sufficiently low. It is noted that these sound levels can be produced by transducers having a relatively small magnetic flux density B and a relatively small coil length l. The transducer of the present invention is therefore both very economical and compact.

The embodiment of FIG. 3 comprises a vibration surface 3 which is constituted by an elongate metal strip attached to a flexible support. The support, which has basically the same function as the flexible edge 7 of FIG. 2, is mounted in a frame 6. At least one magnet 4 is fixed to the metal strip 3. The support 7 may be made of rubber, latex or other suitable material. The transducer of FIG. 3 may be relatively long and narrow and is therefore particularly suitable for mounting on appliances such as television sets, computer screens and the like.

The embodiment of FIG. 4 comprises an inner cylinder 3 and an outer cylinder 6 which are moveably arranged relative to each other. A transducer of this type is disclosed in more detail in U.S. Pat. No. 6,385,327.

In the exemplary embodiment of FIG. 4, the inner cylinder 3 can move up and down relative to the stationary outer cylinder 6, the (top) surface of the inner cylinder 3 constituting the vibration surface. Such an arrangement is sometimes called a "vented box". A driving coil 5 may be mounted in the outer cylinder 6 while a magnet 4 is mounted in the inner cylinder 3, or vice versa. A spring 10 defines the stationary position of the inner cylinder 3. In accordance with the present invention, the transducer 1 is optimized at its resonance frequency $f_0$, as explained above. The embodiment of FIG. 4 makes a particularly large excursion of the vibration surface possible.

Instead of the exemplary transducers of FIGS. 2, 3 and 4 which produce sound directly, that is by means of a vibration surface which is part of the transducer, it is also possible to provide transducers in accordance with the present invention which produce sound indirectly by making another body vibrate. So-called "shakers" can be mounted on surfaces such as device casings or table tops, using these surfaces as vibration surfaces.

A particularly advantageous application of the transducer of the present invention is schematically shown in FIG. 5, where the transducer 1 is part of an audio system 20. The system 20 of FIG. 5 comprises a band-pass filter 22, a detector 23 and a multiplier 24. The filter 22 has a pass-band which corresponds to a first frequency range, for example low audio frequencies (approximately 20 Hz-120 Hz). The filter 22 thus eliminates all frequencies outside this first range. The detector 23 detects the signal received from the filter 22. The detector 23 preferably is a peak detector known per se, but may also be an envelope detector known per se. In a very economical embodiment, the detector may be constituted by a diode.

The signal produced by the detector 23 represents the amplitude of the combined signals present within the first range. Multiplier 24 multiplies this signal by a signal having a frequency $f_G$ which is generated by generator 26. The generator frequency $f_G$ is preferably equal to the resonance frequency $f_0$ of the transducer.

The output signal of the multiplier 14 has a frequency $f_G$ while its amplitude is dependant on the signals contained in the first frequency range. Note that any signal contained in the first range will cause an output signal (having a frequency equal to $f_G$) to be produced.

In addition, the system 10 of FIG. 5 comprises a low-pass filter 25 arranged between the detector 23 and the multiplier 24. This low-pass filter serves to reduce any undesired frequencies which may be generated by the detection process.

The transducer 1 is a transducer in accordance with the present invention and which is preferably driven at its resonance frequency $f_0$. This results in a high sound level. As will be clear from the above discussion, the system 20 produces sound output at the resonance frequency $f_0$ for all audio signals falling within the range defined by band-pass filter 22. This makes it possible to "adjust" low audio frequencies to the properties of the transducer in order to reproduce them at a suitable sound level.

Optionally, a control path 28 may be present in the system 20 between the transducer 1 and the generator 26. This control path allows the generator 26 to adjust the frequency $f_0$ in dependence of transducer parameters such as (instantaneous) impedance, in particular since $f_0$ may vary due to e.g. temperature variations and/or deviations in production parameters.

It will be clear to those skilled in the art that transducer parameters such as the (instantaneous) impedance make it possible to determine the efficiency of the transducer. As the efficiency of the transducer will typically vary with the frequency, an adjustment of the frequency will allow the efficiency to be optimized. To this end the generator may introduce small (and possibly random) frequency variations to determine the efficiency at various frequencies around the current value of $f_G$. If at any of those values the efficiency is greater, the value of $f_G$ may be altered. It will be clear that this (optional) automatic tuning feature even further enhances the utility of the system.

In the above discussion it has been assumed that only a single frequency $f_0$ is used. This is, of course, not essential and it will be understood that if the transducer has multiple resonance frequencies, two or more resonance frequencies $f_0$, $f_1$, etc. may be used. Additionally, or alternatively, two or more transducers having different resonance frequencies $f_0$, $f_1$, etc. may be used in parallel.

The present invention is based upon the insight that small audio transducers can be made to produce relatively high-volume sound at relatively low frequencies by driving the transducer at its resonance frequency. The present invention benefits from the further insight that optimizing the sensitivity of the transducer at its resonance frequency greatly enhances it performance at the desired frequency.

The transducer of the present invention may advantageously be used in audio (stereo) systems. Such systems typically include an audio source, an amplifier and one or more transducers, the audio source for example being a DVD player and/or a radio tuner.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. A transducer for producing sound in response to an audio signal, the transducer comprising an actuator, and a vibration surface mechanically coupled to the actuator, the actuator comprising a magnet and a coil, wherein the transducer has a moving mass selected such that a resonance frequency of the transducer is within a desired frequency range, wherein the desired frequency range is the low frequency audio range substantially between 20 Hz and 100 Hz, wherein the transducer is configured to have a peak input sensitivity of the transducer occur substantially at resonance frequency, and wherein the actuator has a force factor which is equal to the product of a magnetic flux in the coil and a length of the coil, and further wherein for the transducer to have a peak input sensitivity of the transducer occur substantially at the resonance frequency, the ratio of (i) the force factor squared and (ii) the product of (a) electrical resistance of the coil and (b) mechanical resistance of a suspension of the transducer is (iii) greater than 0.6 and smaller than 1.4.

2. The transducer as claimed in claim 1, wherein the ratio is greater than 0.9 and smaller than 1.1, said ratio preferably being substantially equal to 1.

3. The transducer as claimed in claim 1, wherein the vibration surface is a loudspeaker cone.

4. The transducer as claimed in claim 1, wherein the vibration surface comprises an elongate strip.

5. The transducer as claimed in claim 1, wherein the vibration surface comprises a first cylindrical part moveably arranged relative to a second cylindrical part, the first and second cylindrical parts being at least partially concentric.

6. The transducer as claimed in claim 1, wherein the coil is substantially stationary.

7. The transducer as claimed in claim 1, wherein the magnet is substantially stationary.

8. An audio system comprising a transducer according to claim 1; and a processing circuit for receiving the audio signal and for providing an output signal to the transducer, said output signal having an average frequency substantially equal to the resonance frequency of the transducer.

9. The audio system as claimed in claim 8, wherein the processing circuit comprises:

a band-pass filter for limiting the audio signal to a desired frequency range;

a detector coupled to an output of the band-pass filter, said detector providing an output signal indicative of an amplitude of the filtered audio signal;

a generator for generating a signal having a frequency equal to the resonance frequency of the transducer; and a multiplier for multiplying the detector output signal by the generator signal, an output signal from the multiplier having the resonance frequency and being applied to the transducer.

10. A method of driving an audio transducer comprising an actuator, and a vibration surface mechanically coupled to the actuator, the actuator having a coil and a magnet, the method comprising the steps of:

selecting a moving mass of the transducer such that a resonance frequency of the transducer is within a desired frequency range, said desired frequency range being a low frequency audio range substantially between 20 Hz and 100 Hz;

selecting the coil and the magnet of the transducer such that a peak input sensitivity of the transducer occurs substantially at the resonance frequency; and processing an audio input signal to form a transducer signal having an average frequency which is substantially equal to a resonance frequency of the transducer; and wherein the transducer has a force factor which is equal to the product of a magnetic flux in the coil and a length of the coil, and further wherein for the transducer to have a peak input sensitivity of the transducer occur substantially at the resonance frequency, said step of selecting the coil and the magnet includes setting the ratio of (i) the force factor squared and (ii) the product of (a) electrical resistance of the coil and (b) mechanical resistance of a suspension of the transducer is (iii) greater than 0.6 and smaller than 1.4.

11. The method as claimed in claim 10, wherein the ratio is set to be greater than 0.9 and smaller than 1.1, the ratio preferably being substantially equal to 1.

* * * * *